US006736599B1

(12) United States Patent
Jacks et al.

(10) Patent No.: US 6,736,599 B1
(45) Date of Patent: May 18, 2004

(54) FIRST STAGE TURBINE NOZZLE AIRFOIL

(75) Inventors: Curtis John Jacks, Greenville, SC (US); Craig Allen Bielek, Simpsonville, SC (US); Robert Walter Coign, Piedmont, SC (US); Randall Gill, Greenville, SC (US)

(73) Assignee: General Electric Company, Schenectady, NY (US)

( * ) Notice: Subject to any disclaimer, the term of this patent is extended or adjusted under 35 U.S.C. 154(b) by 0 days.

(21) Appl. No.: 10/249,870

(22) Filed: May 14, 2003

(51) Int. Cl.[7] ..... F01D 9/04

(52) U.S. Cl. ..... 415/191; 415/193; 415/208.2; 415/209.1; 415/210.1; 415/211.2

(58) Field of Search ..... 415/191, 192, 415/193, 208.1, 208.2, 209.1, 210.1, 211.2; 416/223 R, 223 A, 243, DIG. 2, DIG. 5

(56) References Cited

U.S. PATENT DOCUMENTS 5,267,834 A 12/1993 Dinh et al.
5,299,915 A 4/1994 Dinh et al.
5,980,209 A 11/1999 Barry et al.
6,398,489 B1 6/2002 Burdgick et al.
6,450,770 B1 9/2002 Wang et al.
6,461,109 B1 10/2002 Wedlake et al.
6,461,110 B1 10/2002 By et al.
6,474,948 B1 11/2002 Pirolla et al.
6,503,054 B1 1/2003 Bielek et al.
6,503,059 B1 1/2003 Frost et al.
6,558,122 B1 * 5/2003 Xu et al. ..... 416/223 A
6,685,434 B1 * 2/2004 Humanchuk et al. ... 416/223 A

* cited by examiner

*Primary Examiner*—Christopher Verdier
(74) *Attorney, Agent, or Firm*—Sutherland Asbill & Brennan LLP

(57) ABSTRACT

The first stage nozzles have airfoil profiles substantially in accordance with Cartesian coordinate values of X, Y and Z set forth Table 1. The X and Y values are in inches and the Z value is non-dimensional along the nozzle-stacking axis coincident with a turbine radius and convertible to a Z distance in inches from the turbine axis by multiplying the Z value by the height of the airfoil and adding the root radius to the result. The X and Y distances may be scalable as a function of the same constant or number to provide a scaled up or scaled down airfoil section for the nozzle. The nominal airfoil given by the X, Y and Z distances lies within an envelope of ±0.160 inches.

19 Claims, 3 Drawing Sheets

FIRST STAGE TURBINE NOZZLE AIRFOIL

BACKGROUND OF INVENTION

1. Technical Field

The present invention relates to a turbine nozzle for a gas turbine and particularly relates to a first stage turbine nozzle airfoil profile.

2. Background of the Invention

In recent years, advanced gas turbines have trended toward increasing firing temperatures and efforts to improve cooling of the various turbine components. In a particular gas turbine design of the assignee, a high output turbine that uses air cooling is undergoing development. It will be appreciated that the design and construction of the turbine buckets and nozzles require optimized aerodynamic efficiency, as well as aerodynamic and mechanical loading.

SUMMARY OF INVENTION

In accordance with a preferred embodiment of the present invention, there is provided a unique airfoil profile for the nozzles of a turbine stage, preferably the first stage of a gas turbine. The nozzle airfoil profile is defined by a unique loci of points to achieve the necessary efficiency whereby improved turbine performance is obtained. These unique loci of points define the nominal airfoil profile and are identified by the X, Y and Z Cartesian coordinates of Table 1 which follows. The 1200 points for the coordinate values shown in Table 1 are for a cold, i.e., room temperature, profile at various planar cross sections of the nozzle airfoil along its length. The X and Y coordinates are given in distance dimensions, e.g., units of inches, and are joined smoothly at each Z location to form a smooth continuous airfoil cross section. The Z coordinates are given in nondimensionalized form from 0 to 1 along a nozzle stacking axis coincident with a radius from the axis of turbine rotation. By multiplying the airfoil height dimension, e.g., in inches, by the nondimensional Z value of Table 1 and adding that value to the root radius of the nozzle, the actual Z distance from the rotational axis, e.g., in inches, is obtained. Each defined cross section is then joined smoothly with adjacent cross sections to form the complete airfoil shape.

It will be appreciated that as each nozzle airfoil heats up in use, the profile will change as a result of stress and temperature. Thus, the cold or room temperature profile is given by the X, Y and Z coordinates for manufacturing purposes. Because the manufactured nozzle airfoil profile may be different from the nominal airfoil profile given by the following table, a distance of plus or minus 0.160 inches from the nominal profile in a direction normal to any surface location along the nominal profile defines the profile envelope for this nozzle airfoil. The envelope includes any possible airfoil surface coating process. The design is robust to this variation without impairment of the mechanical and aerodynamic functions.

It also will be appreciated that the airfoil can be scaled up or scaled down geometrically for introduction into similar turbine designs. Consequently, the X and Y coordinates in inches and the Z coordinates, when converted to inches, of the nominal airfoil profile given below are a function of the same constant or number. That is, the X and Y and optionally the Z coordinate values in inches may be multiplied or divided by the same constant or number to provide a scaled up or scaled down version of the nozzle airfoil profile while retaining the airfoil section shape.

In a preferred embodiment according to the present invention, there is provided a turbine nozzle having an airfoil shape in an envelope within ±0.160 inches in a direction normal to any airfoil surface location wherein the airfoil has a nominal profile substantially in accordance with Cartesian coordinate values of X, Y and Z set forth in Table 1. Z is a nondimensional value along a nozzle stacking axis coincident with a radius from a turbine axis of rotation convertible to a Z distance in inches from said turbine axis by multiplying the Z value by a height of the airfoil and adding that product to a root radius of the nozzle. X and Y are distances in inches defining the airfoil profile at each distance Z, the profiles at the Z distances being joined smoothly with one another to form a complete airfoil shape.

In a further preferred embodiment according to the present invention, there is provided a turbine nozzle having an uncoated nominal airfoil profile substantially in accordance with Cartesian coordinate values of X, Y and Z set forth in Table 1. Z is a nondimensional value along a nozzle stacking axis coincident with a radius from a turbine axis of rotation convertible to a Z distance in inches from said turbine axis by multiplying the Z value by a height of the airfoil and adding that product to a root radius of the nozzle and wherein X and Y are distances in inches defining the airfoil profile at each distance Z, the profiles at the Z distances being joined smoothly with one another to form a complete airfoil shape, the X and Y distances being scalable as a function of the same constant or number to provide a scaled up or scaled down nozzle airfoil.

In a further preferred embodiment according to the present invention, there is provided a turbine including a turbine nozzle arrangement having a number of nozzles, each of the nozzles having an airfoil shape in an envelope within ±0.160 inches in a direction normal to any airfoil surface location wherein the airfoil has a nominal profile substantially in accordance with Cartesian coordinate values of X, Y and Z set forth in Table 1, wherein Z is a nondimensional value along a nozzle centerline coincident with a radius from a turbine axis of rotation convertible to a Z distance in inches from said turbine axis by multiplying the Z value by a height of the airfoil and adding that product to a root radius of the nozzle, and wherein X and Y are distances in inches defining the airfoil profile at each distance Z, the profiles at the Z distances being joined smoothly with one another to form a complete airfoil shape.

In a further preferred embodiment according to the present invention, there is provided a turbine including a turbine nozzle arrangement having a number of nozzles, each of the nozzles having an uncoated nominal airfoil profile substantially in accordance with Cartesian coordinate values of X, Y and Z set forth in Table 1, wherein Z is a nondimensional value along a nozzle centerline coincident with a radius from a turbine axis of rotation convertible to a Z distance in inches from said turbine axis of rotation by miultiplying the Z value by a height of the airfoil and adding that product to a root radius of the nozzle and wherein X and Y are distances in inches defining the airfoil profile at each distance Z, the profiles at the Z distances being joined smoothly with one another to form a complete airfoil shape. The X and Y distances being scalable as a function of the same constant or number to provide a scaled up or scaled down nozzle airfoil.

These and other features of the present invention will become apparent upon review of the following detailed description when taken in conjunction with the drawings and the appended claims.

DETAILED DESCRIPTION

Figure 1:
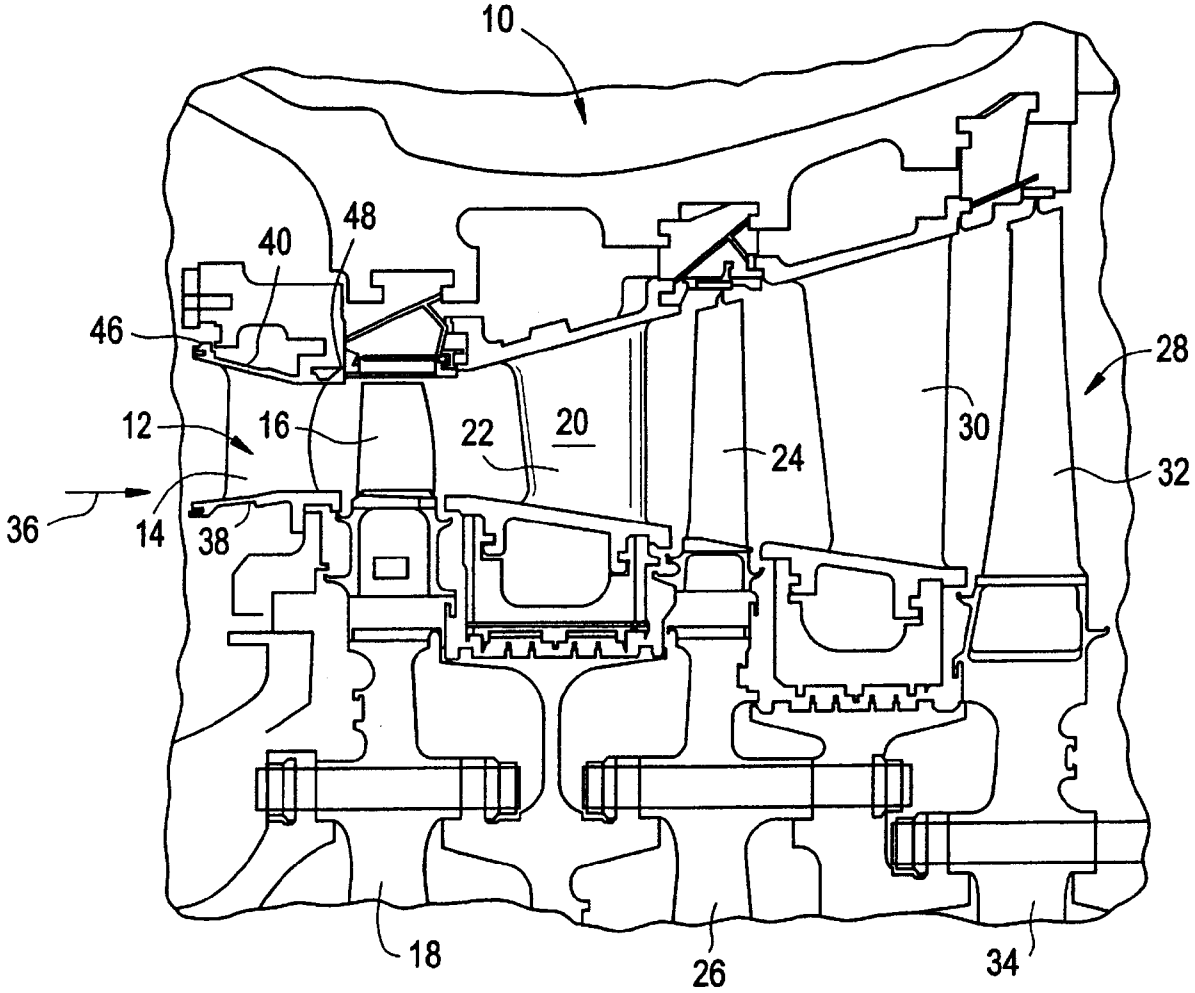
FIG. 1 is a schematic illustration of a turbine having a first stage turbine nozzle arrangement employing the nozzles and nozzle airfoils hereof.

Referring now to FIG. 1, there is illustrated a portion of a turbine in which a first stage turbine nozzle having an airfoil profile as defined herein may be utilized. The turbine includes first, second and third stage nozzle arrangements having nozzles in conjunction with the respective buckets of the various stages of the rotor. It will be appreciated that a three stage turbine is illustrated.

Referring now to FIG. 1, there is illustrated a portion of a turbine, generally designated 10, having a first stage nozzle, generally designated 12. The first stage nozzle 12 includes a number of vanes 14 having an airfoil shape or profile spaced circumferentially one from the other. The first stage nozzle 12 is arranged in conjunction with a number of buckets 16. The buckets 16 are circumferentially spaced about a rotatable turbine wheel 18.

The illustrated turbine 10 includes three stages, the first stage 12; the second stage 20, also including a number of circumferentially spaced nozzle vanes 22 and a number of circumferentially spaced buckets 24 mounted on a second stage wheel 26; and a third stage 28 also including a number of circumferentially spaced nozzle vanes 30 and a number of circumferentially spaced buckets 32 mounted on a third stage wheel 34. It will be appreciated that the nozzle vanes and buckets lie in the hot gas path of the turbine. The gases flow through the turbine 10 in the direction of the arrow 36.

Figure 2:
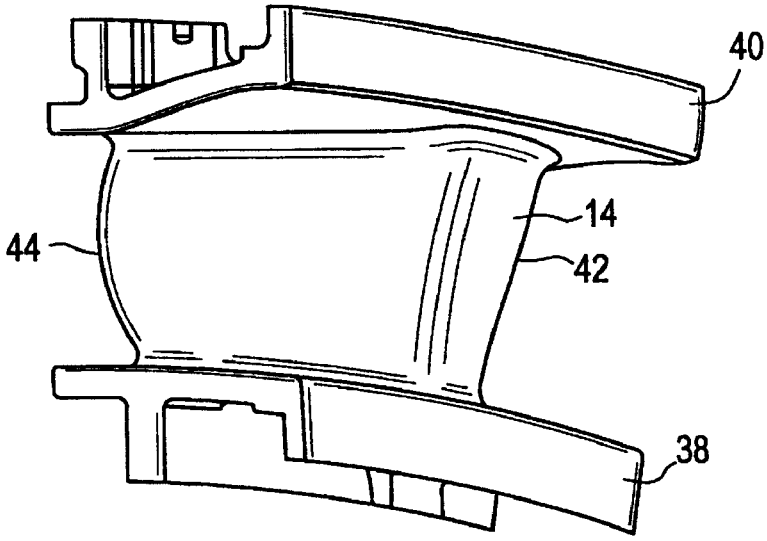
FIG. 2 is a frontal view of a first stage turbine nozzle including an airfoil and sidewalls in accordance with a preferred embodiment of the present invention.
Figure 3:
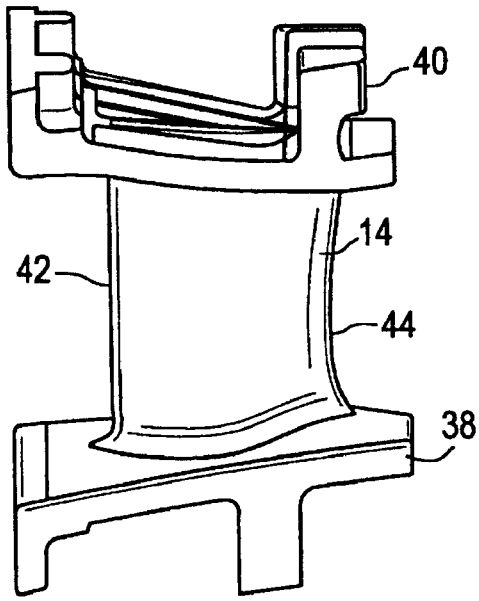
FIG. 3 is a suction side view of a first stage turbine nozzle including an airfoil and sidewalls in accordance with a preferred embodiment of the present invention.
Figure 4:
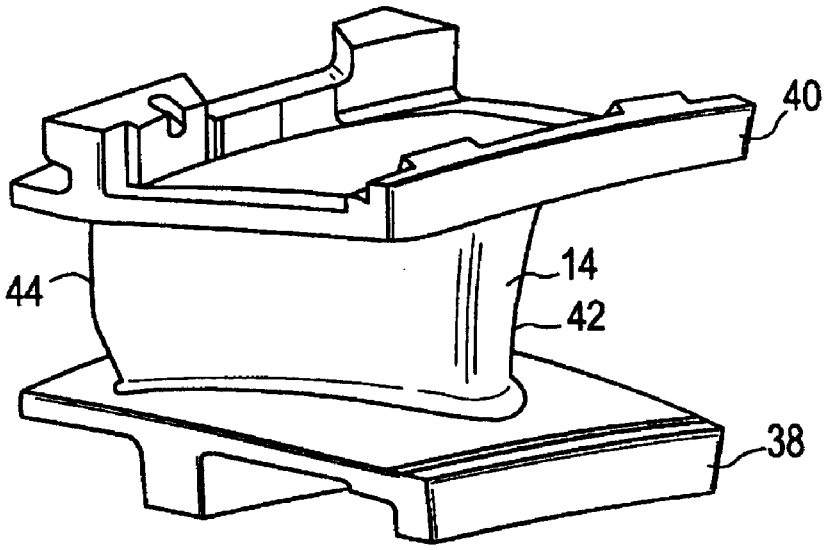
FIG. 4 is a pressure side isometric view of a first stage turbine nozzle including an airfoil and sidewalls in accordance with a preferred embodiment of the present invention.

Referring to FIGS. 2, 3, and 4, the nozzle vanes 14 of the first stage 12 are disposed between inner and outer sidewalls 38 and 40, respectively, by which the nozzles 12 form an annulus about the rotor axis. As illustrated, the nozzle vanes 14 have leading and trailing edges 42 and 44, respectively, with hooks 46 and 48 for securing the nozzle vane segments to the nonrotatable casing of the turbine. As will be appreciated, the nozzle vanes 14 have various passages therethrough for flowing a cooling medium through the vanes. In the preferred and illustrated embodiment of the first stage nozzle 12 for this particular turbine, there are thirty two (32) nozzles vanes 14 mounted on the first stage nozzle arrangement.

Figure 5:
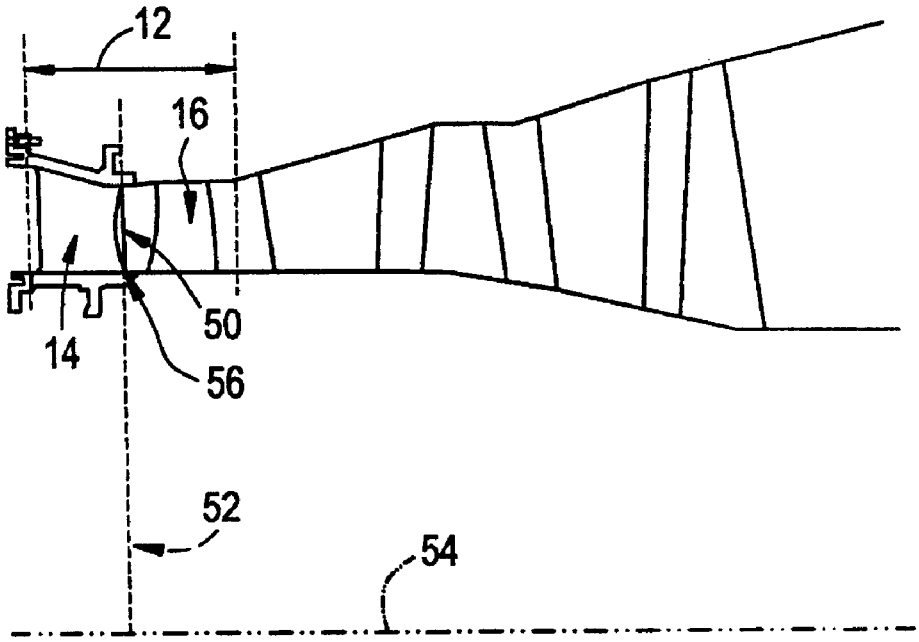
FIG. 5 is a schematic illustration of a turbine having a first stage turbine nozzle arrangement employing the nozzles and nozzle airfoils hereof.

Referring now to FIG. 5, there is illustrated a nozzle vane 14 for the first stage constructed in accordance with a three dimensional compound curvature. A Cartesian coordinate system of X, Y and Z values given in Table 1 defines the profile of nozzle airfoil. The coordinate values for the X and Y coordinates are set forth in inches in Table 1 although other units of dimensions may be used. The Z values are set forth in Table 1 in nondimensional form from 0 to 1 along a nozzle stacking axis 50 coincident with a radius 52 from the turbine axis of rotation 54.

To convert the Z value to a Z coordinate value, e.g., in inches, from the turbine axis of rotation 54, the nondimensional Z value given in the table is multiplied by the height of the airfoil 14 in inches and that product is added to a root radius 56 in inches. The airfoil 14 height is measured from the intersection of the nozzle stacking axis 50, which is along the radius 52 from the centerline or axis of the turbine 54, and the root radius 56 of the defined airfoil geometry. The root radius 56 extends along the base of the vane 14 from the nozzle stacking line 50. The Z coordinate value of this intersection with the root radius 56 for each nozzle vane 14 of the first stage 12 in a preferred embodiment is approximately 21.25 inches. The height of the first stage airfoil nozzle vane 14 from the root radius 56 in this preferred embodiment is approximately 4.275 inches. The Cartesian coordinate system has orthogonally related X, Y and Z axes with the Z axis extending perpendicular to a plane normal to a plane containing the X and Y values. When converted to inches, the Z distance commences at 0 at the turbine centerline. The Y axis lies parallel to the turbine rotor centerline, i.e., the rotary axis 54.

By defining X and Y coordinate values at selected locations in a Z direction normal to the X, Y plane, the profile of the airfoil 14 can be ascertained. By connecting the X and Y values with smooth continuing arcs, each profile section at each distance Z is fixed. The surface profiles of the various surface locations between the distances Z are determined by smoothly connecting the adjacent crosssections to one another to form the airfoil surface. These values represent the airfoil profiles at ambient, nonoperating or nonhot conditions and are for an uncoated airfoil. The sign convention assigns a positive value to Z values and positive and negative values for the X and Y coordinates as typically used in Cartesian coordinate systems.

The Table 1 values are generated and shown to three decimal places for determining the profile of the airfoil 14. There are typical manufacturing tolerances as well as coatings, which must be accounted for in the actual profile of the airfoil 14. Accordingly, the values for the profile given in Table 1 are for a nominal airfoil. It will therefore be appreciated that plus or minus typical manufacturing tolerances, i.e. plus or minus values, including any coating thicknesses, are additive to the X and Y values given in Table 1 below. Accordingly, a distance of ±0.160 inches in a direction normal to any surface location along the airfoil profile defines an airfoil profile envelope for this particular nozzle airfoil design and turbine.

Table 1: The coordinate values given below provide the preferred nominal profile envelope.

| X | Y | Z' |
|---|---|---|
| −2.301 | −4.340 | 0.000 |
| −2.702 | −3.689 | 0.000 |
| −2.583 | −4.160 | 0.000 |
| −2.595 | −3.462 | 0.000 |
| −1.542 | −4.320 | 0.000 |
| −2.225 | −4.378 | 0.000 |
| −2.521 | −4.218 | 0.000 |
| −1.442 | −4.184 | 0.000 |
| −2.675 | −4.020 | 0.000 |
| −1.991 | −4.473 | 0.000 |
| −2.640 | −3.533 | 0.000 |
| −2.635 | −4.094 | 0.000 |
| −1.230 | −3.820 | 0.000 |
| −2.149 | −4.414 | 0.000 |
| −1.909 | −4.488 | 0.000 |
| −2.452 | −4.265 | 0.000 |
| −2.716 | −3.857 | 0.000 |
| −1.271 | −3.894 | 0.000 |

-continued

| X | Y | Z' |
|---|---|---|
| −2.072 | −4.447 | 0.000 |
| −1.600 | −4.381 | 0.000 |
| −1.742 | −4.469 | 0.000 |
| −1.824 | −4.488 | 0.000 |
| −2.546 | −3.393 | 0.000 |
| −1.397 | −4.113 | 0.000 |
| −2.702 | −3.940 | 0.000 |
| −2.716 | −3.773 | 0.000 |
| −1.667 | −4.432 | 0.000 |
| −1.353 | −4.041 | 0.000 |
| −2.677 | −3.609 | 0.000 |
| −2.377 | −4.303 | 0.000 |
| −1.312 | −3.967 | 0.000 |
| −1.490 | −4.254 | 0.000 |
| −1.835 | −2.563 | 0.000 |
| −1.150 | −3.671 | 0.000 |
| −2.346 | −3.122 | 0.000 |
| −1.899 | −2.618 | 0.000 |
| −2.295 | −3.055 | 0.000 |
| −1.110 | −3.597 | 0.000 |
| −0.825 | −3.080 | 0.000 |
| −1.632 | −2.412 | 0.000 |
| −0.948 | −3.301 | 0.000 |
| −0.989 | −3.375 | 0.000 |
| −0.699 | −2.861 | 0.000 |
| −0.907 | −3.227 | 0.000 |
| −1.961 | −2.675 | 0.000 |
| −2.134 | −2.859 | 0.000 |
| −2.397 | −3.189 | 0.000 |
| −0.866 | −3.153 | 0.000 |
| −1.701 | −2.460 | 0.000 |
| −0.783 | −3.007 | 0.000 |
| −2.242 | −2.989 | 0.000 |
| −1.029 | −3.449 | 0.000 |
| −2.447 | −3.257 | 0.000 |
| −2.078 | −2.796 | 0.000 |
| −1.769 | −2.510 | 0.000 |
| −2.497 | −3.325 | 0.000 |
| −2.020 | −2.735 | 0.000 |
| −1.070 | −3.523 | 0.000 |
| −0.613 | −2.715 | 0.000 |
| −1.190 | −3.745 | 0.000 |
| −2.189 | −2.923 | 0.000 |
| −0.656 | −2.788 | 0.000 |
| −0.741 | −2.934 | 0.000 |
| −0.130 | −1.480 | 0.000 |
| −0.440 | −2.426 | 0.000 |
| −0.396 | −2.353 | 0.000 |
| −0.464 | −1.737 | 0.000 |
| −0.535 | −1.784 | 0.000 |
| −0.570 | −2.643 | 0.000 |
| −0.308 | −2.210 | 0.000 |
| −0.264 | −2.138 | 0.000 |
| −0.067 | −1.424 | 0.000 |
| −1.122 | −2.116 | 0.000 |
| −0.220 | −2.066 | 0.000 |
| −0.175 | −1.995 | 0.000 |
| 0.130 | −1.923 | 0.000 |
| −0.041 | −1.780 | 0.000 |
| 0.004 | −1.709 | 0.000 |
| −0.824 | −1.956 | 0.000 |
| −1.562 | −2.365 | 0.000 |
| −0.751 | −1.915 | 0.000 |
| 0.049 | −1.637 | 0.000 |
| −0.898 | −1.997 | 0.000 |
| −0.194 | −1.535 | 0.000 |
| −1.047 | −2.076 | 0.000 |
| 0.094 | −1.566 | 0.000 |
| 0.140 | −1.495 | 0.000 |
| 0.972 | −2.037 | 0.000 |
| 0.185 | −1.424 | 0.000 |
| −1.417 | −2.278 | 0.000 |
| −1.196 | −2.155 | 0.000 |
| −0.527 | −2.570 | 0.000 |
| −0.395 | −1.689 | 0.000 |
| −0.606 | −1.829 | 0.000 |
| −0.484 | −2.498 | 0.000 |

-continued

| X | Y | Z' |
|---|---|---|
| −0.327 | −1.639 | 0.000 |
| −0.260 | −1.588 | 0.000 |
| −1.490 | −2.321 | 0.000 |
| −0.353 | −2.281 | 0.000 |
| −0.005 | −1.367 | 0.000 |
| −1.270 | −2.196 | 0.000 |
| −0.678 | −1.872 | 0.000 |
| −1.344 | −2.236 | 0.000 |
| −0.086 | −1.852 | 0.000 |
| 0.116 | −1.249 | 0.000 |
| 0.500 | −0.925 | 0.000 |
| 0.347 | −1.004 | 0.000 |
| 0.459 | −0.879 | 0.000 |
| 0.175 | −1.189 | 0.000 |
| 0.402 | −0.940 | 0.000 |
| 0.320 | −1.210 | 0.000 |
| 0.233 | −1.128 | 0.000 |
| 0.230 | −1.352 | 0.000 |
| 0.275 | −1.281 | 0.000 |
| 0.365 | −1.139 | 0.000 |
| 0.056 | −1.309 | 0.000 |
| 0.410 | −1.067 | 0.000 |
| 0.455 | −0.996 | 0.000 |
| 0.500 | −0.925 | 0.000 |
| 0.291 | −1.066 | 0.000 |
| −1.178 | −3.966 | 0.111 |
| −2.219 | −4.499 | 0.111 |
| −2.135 | −4.523 | 0.111 |
| −2.301 | −4.470 | 0.111 |
| −2.642 | −4.213 | 0.111 |
| −2.049 | −4.540 | 0.111 |
| −2.693 | −3.793 | 0.111 |
| −1.963 | −4.550 | 0.111 |
| −2.591 | −4.283 | 0.111 |
| −1.875 | −4.551 | 0.111 |
| −1.789 | −4.542 | 0.111 |
| −2.529 | −4.344 | 0.111 |
| −1.704 | −4.521 | 0.111 |
| −2.458 | −4.395 | 0.111 |
| −1.624 | −4.488 | 0.111 |
| −2.512 | −3.498 | 0.111 |
| −2.381 | −4.436 | 0.111 |
| −1.549 | −4.443 | 0.111 |
| −1.480 | −4.389 | 0.111 |
| −1.310 | −4.191 | 0.111 |
| −2.567 | −3.566 | 0.111 |
| −1.418 | −4.328 | 0.111 |
| −2.619 | −3.636 | 0.111 |
| −2.662 | −3.711 | 0.111 |
| −1.362 | −4.262 | 0.111 |
| −1.219 | −4.043 | 0.111 |
| −2.712 | −3.878 | 0.111 |
| −1.263 | −4.118 | 0.111 |
| −2.716 | −3.965 | 0.111 |
| −2.706 | −4.051 | 0.111 |
| −2.681 | −4.135 | 0.111 |
| −1.138 | −3.888 | 0.111 |
| −0.894 | −3.329 | 0.111 |
| −1.064 | −3.730 | 0.111 |
| −1.624 | −2.538 | 0.111 |
| −0.994 | −3.570 | 0.111 |
| −0.961 | −3.493 | 0.111 |
| −0.927 | −3.409 | 0.111 |
| −1.688 | −2.598 | 0.111 |
| −1.751 | −2.659 | 0.111 |
| −0.861 | −3.248 | 0.111 |
| −0.829 | −3.167 | 0.111 |
| −0.796 | −3.056 | 0.111 |
| −1.813 | −2.720 | 0.111 |
| −1.874 | −2.782 | 0.111 |
| −0.731 | −2.924 | 0.111 |
| −1.101 | −3.809 | 0.111 |
| −1.995 | −2.907 | 0.111 |
| −2.055 | −2.971 | 0.111 |
| −2.114 | −3.035 | 0.111 |
| −2.172 | −3.100 | 0.111 |
| −2.230 | −3.165 | 0.111 |

-continued

| X | Y | Z' |
|---|---|---|
| −1.935 | −2.844 | 0.111 |
| −2.288 | −3.231 | 0.111 |
| −2.345 | −3.297 | 0.111 |
| −2.401 | −3.363 | 0.111 |
| −2.457 | −3.430 | 0.111 |
| −0.698 | −2.844 | 0.111 |
| −0.763 | −3.005 | 0.111 |
| −1.029 | −3.650 | 0.111 |
| −0.534 | −1.535 | 0.111 |
| −0.594 | −1.599 | 0.111 |
| −1.560 | −2.479 | 0.111 |
| −0.655 | −1.661 | 0.111 |
| −0.716 | −1.723 | 0.111 |
| −1.431 | −2.363 | 0.111 |
| −0.842 | −1.843 | 0.111 |
| −0.907 | −1.902 | 0.111 |
| −0.332 | −1.957 | 0.111 |
| −0.971 | −1.961 | 0.111 |
| −0.665 | −2.763 | 0.111 |
| −0.779 | −1.783 | 0.111 |
| −1.037 | −2.019 | 0.111 |
| −1.102 | −2.076 | 0.111 |
| −0.632 | −2.682 | 0.111 |
| −0.599 | −2.601 | 0.111 |
| −0.566 | −2.521 | 0.111 |
| −0.533 | −2.440 | 0.111 |
| −0.500 | −2.359 | 0.111 |
| −0.467 | −2.279 | 0.111 |
| −1.168 | −2.133 | 0.111 |
| −1.234 | −2.191 | 0.111 |
| −0.433 | −2.198 | 0.111 |
| −0.400 | −2.118 | 0.111 |
| −0.366 | −2.037 | 0.111 |
| −0.298 | −1.876 | 0.111 |
| −0.230 | −1.716 | 0.111 |
| −0.196 | −1.636 | 0.111 |
| −1.299 | −2.248 | 0.111 |
| −0.162 | −1.555 | 0.111 |
| −0.128 | −1.475 | 0.111 |
| −1.365 | −2.305 | 0.111 |
| −0.264 | −1.796 | 0.111 |
| −1.496 | −2.421 | 0.111 |
| −0.418 | −1.405 | 0.111 |
| −0.476 | −1.470 | 0.111 |
| 0.100 | −0.704 | 0.111 |
| 0.052 | −0.777 | 0.111 |
| 0.192 | −0.556 | 0.111 |
| −0.046 | −0.921 | 0.111 |
| 0.242 | −0.590 | 0.111 |
| 0.004 | −0.850 | 0.111 |
| −0.096 | −0.992 | 0.111 |
| −0.148 | −1.063 | 0.111 |
| −0.200 | −1.133 | 0.111 |
| −0.253 | −1.202 | 0.111 |
| 0.109 | −0.912 | 0.111 |
| −0.094 | −1.395 | 0.111 |
| −0.060 | −1.314 | 0.111 |
| −0.307 | −1.270 | 0.111 |
| −0.026 | −1.234 | 0.111 |
| 0.008 | −1.154 | 0.111 |
| 0.041 | −1.073 | 0.111 |
| 0.145 | −0.630 | 0.111 |
| 0.075 | −0.993 | 0.111 |
| 0.142 | −0.832 | 0.111 |
| 0.176 | −0.751 | 0.111 |
| 0.209 | −0.671 | 0.111 |
| 0.242 | −0.590 | 0.111 |
| −0.362 | −1.338 | 0.111 |
| −1.675 | −4.612 | 0.222 |
| −1.764 | −4.635 | 0.222 |
| −1.591 | −4.576 | 0.222 |
| −1.314 | −4.341 | 0.222 |
| −1.259 | −4.268 | 0.222 |
| −1.078 | −3.950 | 0.222 |
| −1.374 | −4.410 | 0.222 |
| −1.440 | −4.474 | 0.222 |
| −1.209 | −4.191 | 0.222 |

-continued

| X | Y | Z' |
|---|---|---|
| −1.119 | −4.032 | 0.222 |
| −1.162 | −4.113 | 0.222 |
| −1.512 | −4.530 | 0.222 |
| −0.937 | −3.612 | 0.222 |
| −0.710 | −2.915 | 0.222 |
| −0.789 | −3.178 | 0.222 |
| −1.004 | −3.782 | 0.222 |
| −1.506 | −2.567 | 0.222 |
| −1.566 | −2.636 | 0.222 |
| −1.627 | −2.704 | 0.222 |
| −0.685 | −2.827 | 0.222 |
| −1.040 | −3.866 | 0.222 |
| −0.905 | −3.526 | 0.222 |
| −0.845 | −3.353 | 0.222 |
| −0.817 | −3.266 | 0.222 |
| −0.969 | −3.697 | 0.222 |
| −0.736 | −3.003 | 0.222 |
| −0.875 | −3.440 | 0.222 |
| −0.763 | −3.091 | 0.222 |
| −2.604 | −4.368 | 0.222 |
| −1.855 | −4.646 | 0.222 |
| −2.515 | −3.629 | 0.222 |
| −2.713 | −4.120 | 0.222 |
| −2.453 | −3.562 | 0.222 |
| −2.577 | −3.697 | 0.222 |
| −2.631 | −3.770 | 0.222 |
| −2.674 | −3.851 | 0.222 |
| −2.703 | −3.938 | 0.222 |
| −2.716 | −4.028 | 0.222 |
| −2.692 | −4.209 | 0.222 |
| −2.655 | −4.293 | 0.222 |
| −2.467 | −4.489 | 0.222 |
| −2.387 | −4.533 | 0.222 |
| −2.540 | −4.434 | 0.222 |
| −2.303 | −4.570 | 0.222 |
| −2.216 | −4.599 | 0.222 |
| −2.128 | −4.622 | 0.222 |
| −2.038 | −4.638 | 0.222 |
| −1.946 | −4.647 | 0.222 |
| −2.069 | −3.169 | 0.222 |
| −1.688 | −2.772 | 0.222 |
| −1.751 | −2.839 | 0.222 |
| −1.814 | −2.906 | 0.222 |
| −1.877 | −2.972 | 0.222 |
| −1.941 | −3.038 | 0.222 |
| −2.005 | −3.103 | 0.222 |
| −2.133 | −3.234 | 0.222 |
| −2.198 | −3.299 | 0.222 |
| −2.262 | −3.364 | 0.222 |
| −2.326 | −3.430 | 0.222 |
| −2.390 | −3.496 | 0.222 |
| −0.607 | −1.299 | 0.222 |
| −0.306 | −1.412 | 0.222 |
| −0.653 | −1.378 | 0.222 |
| −0.700 | −1.456 | 0.222 |
| −0.846 | −1.689 | 0.222 |
| −0.896 | −1.766 | 0.222 |
| −0.999 | −1.917 | 0.222 |
| −0.375 | −1.677 | 0.222 |
| −0.329 | −1.500 | 0.222 |
| −0.748 | −1.534 | 0.222 |
| −0.636 | −2.651 | 0.222 |
| −0.796 | −1.612 | 0.222 |
| −0.469 | −2.032 | 0.222 |
| −0.611 | −2.562 | 0.222 |
| −0.492 | −2.120 | 0.222 |
| −0.352 | −1.589 | 0.222 |
| −0.947 | −1.842 | 0.222 |
| −0.399 | −1.766 | 0.222 |
| −0.516 | −2.209 | 0.222 |
| −0.563 | −2.386 | 0.222 |
| −0.445 | −1.943 | 0.222 |
| −0.540 | −2.297 | 0.222 |
| −0.422 | −1.854 | 0.222 |
| −0.660 | −2.739 | 0.222 |
| −0.587 | −2.474 | 0.222 |
| −0.014 | −0.257 | 0.222 |

-continued

| X | Y | Z' |
|---|---|---|
| −0.472 | −1.059 | 0.222 |
| −0.561 | −1.219 | 0.222 |
| −0.191 | −0.968 | 0.222 |
| −0.035 | −0.346 | 0.222 |
| −0.236 | −1.146 | 0.222 |
| −0.014 | −0.257 | 0.222 |
| −0.123 | −0.702 | 0.222 |
| −0.429 | −0.978 | 0.222 |
| −0.071 | −0.236 | 0.222 |
| −0.101 | −0.613 | 0.222 |
| −0.259 | −1.234 | 0.222 |
| −0.106 | −0.320 | 0.222 |
| −0.143 | −0.404 | 0.222 |
| −0.079 | −0.524 | 0.222 |
| −0.181 | −0.488 | 0.222 |
| −0.282 | −1.323 | 0.222 |
| −0.220 | −0.571 | 0.222 |
| −0.386 | −0.897 | 0.222 |
| −0.145 | −0.791 | 0.222 |
| −0.168 | −0.880 | 0.222 |
| −0.260 | −0.653 | 0.222 |
| −0.213 | −1.057 | 0.222 |
| −0.301 | −0.735 | 0.222 |
| −0.516 | −1.139 | 0.222 |
| −0.343 | −0.816 | 0.222 |
| −0.057 | −0.435 | 0.222 |
| −1.106 | −2.066 | 0.222 |
| −1.161 | −2.139 | 0.222 |
| −1.216 | −2.212 | 0.222 |
| −1.272 | −2.284 | 0.222 |
| −1.330 | −2.356 | 0.222 |
| −1.387 | −2.427 | 0.222 |
| −1.446 | −2.497 | 0.222 |
| −1.052 | −1.992 | 0.222 |
| −2.248 | −4.681 | 0.333 |
| −1.876 | −4.772 | 0.333 |
| −2.684 | −3.940 | 0.333 |
| −2.159 | −4.716 | 0.333 |
| −1.122 | −4.118 | 0.333 |
| −1.315 | −4.451 | 0.333 |
| −1.972 | −4.763 | 0.333 |
| −2.586 | −3.775 | 0.333 |
| −2.642 | −3.854 | 0.333 |
| −1.780 | −4.766 | 0.333 |
| −2.632 | −4.400 | 0.333 |
| −2.710 | −4.033 | 0.333 |
| −2.419 | −4.593 | 0.333 |
| −1.261 | −4.371 | 0.333 |
| −2.718 | −4.129 | 0.333 |
| −2.707 | −4.224 | 0.333 |
| −1.686 | −4.745 | 0.333 |
| −2.678 | −4.316 | 0.333 |
| −1.516 | −4.657 | 0.333 |
| −2.571 | −4.475 | 0.333 |
| −2.519 | −3.706 | 0.333 |
| −1.165 | −4.205 | 0.333 |
| −1.598 | −4.708 | 0.333 |
| −2.066 | −4.744 | 0.333 |
| −1.442 | −4.596 | 0.333 |
| −2.500 | −4.539 | 0.333 |
| −1.375 | −4.526 | 0.333 |
| −2.335 | −4.639 | 0.333 |
| −1.082 | −4.031 | 0.333 |
| −1.211 | −4.289 | 0.333 |
| −2.378 | −3.576 | 0.333 |
| −2.449 | −3.640 | 0.333 |
| −2.234 | −3.447 | 0.333 |
| −1.045 | −3.942 | 0.333 |
| −0.709 | −2.837 | 0.333 |
| −1.765 | −2.964 | 0.333 |
| −2.094 | −3.315 | 0.333 |
| −1.010 | −3.852 | 0.333 |
| −0.977 | −3.762 | 0.333 |
| −0.945 | −3.671 | 0.333 |
| −0.831 | −3.303 | 0.333 |
| −0.805 | −3.210 | 0.333 |
| −0.780 | −3.117 | 0.333 |

-continued

| X | Y | Z' |
|---|---|---|
| −0.915 | −3.579 | 0.333 |
| −1.474 | −2.581 | 0.333 |
| −1.828 | −3.037 | 0.333 |
| −1.958 | −3.179 | 0.333 |
| −0.886 | −3.488 | 0.333 |
| −2.025 | −3.248 | 0.333 |
| −0.732 | −2.931 | 0.333 |
| −0.756 | −3.024 | 0.333 |
| −1.586 | −2.737 | 0.333 |
| −1.892 | −3.109 | 0.333 |
| −1.529 | −2.659 | 0.333 |
| −1.704 | −2.889 | 0.333 |
| −2.164 | −3.382 | 0.333 |
| −0.858 | −3.395 | 0.333 |
| −2.306 | −3.511 | 0.333 |
| −1.644 | −2.814 | 0.333 |
| −1.366 | −2.421 | 0.333 |
| −0.445 | −1.614 | 0.333 |
| −0.935 | −1.670 | 0.333 |
| −0.686 | −2.744 | 0.333 |
| −1.314 | −2.340 | 0.333 |
| −1.263 | −2.258 | 0.333 |
| −0.725 | −1.236 | 0.333 |
| −1.419 | −2.501 | 0.333 |
| −0.621 | −2.462 | 0.333 |
| −0.807 | −1.411 | 0.333 |
| −0.766 | −1.324 | 0.333 |
| −1.024 | −1.841 | 0.333 |
| −1.164 | −2.093 | 0.333 |
| −0.664 | −2.650 | 0.333 |
| −0.643 | −2.556 | 0.333 |
| −0.849 | −1.498 | 0.333 |
| −0.601 | −2.368 | 0.333 |
| −0.891 | −1.584 | 0.333 |
| −0.580 | −2.274 | 0.333 |
| −0.560 | −2.180 | 0.333 |
| −0.540 | −2.086 | 0.333 |
| −0.979 | −1.755 | 0.333 |
| −0.521 | −1.991 | 0.333 |
| −0.501 | −1.897 | 0.333 |
| −0.408 | −1.424 | 0.333 |
| −1.070 | −1.925 | 0.333 |
| −1.116 | −2.009 | 0.333 |
| −0.482 | −1.803 | 0.333 |
| −0.463 | −1.708 | 0.333 |
| −0.426 | −1.519 | 0.333 |
| −1.213 | −2.176 | 0.333 |
| −0.304 | −0.856 | 0.333 |
| −0.338 | −1.046 | 0.333 |
| −0.686 | −1.149 | 0.333 |
| −0.570 | −0.884 | 0.333 |
| −0.321 | −0.951 | 0.333 |
| −0.254 | −0.572 | 0.333 |
| −0.495 | −0.706 | 0.333 |
| −0.390 | −1.330 | 0.333 |
| −0.646 | −1.061 | 0.333 |
| −0.238 | −0.477 | 0.333 |
| −0.373 | −1.235 | 0.333 |
| −0.532 | −0.795 | 0.333 |
| −0.222 | −0.382 | 0.333 |
| −0.191 | −0.192 | 0.333 |
| −0.287 | −0.761 | 0.333 |
| −0.355 | −1.141 | 0.333 |
| −0.351 | −0.349 | 0.333 |
| −0.221 | 0.013 | 0.333 |
| −0.160 | −0.002 | 0.333 |
| −0.386 | −0.439 | 0.333 |
| −0.458 | −0.617 | 0.333 |
| −0.160 | −0.002 | 0.333 |
| −0.206 | −0.287 | 0.333 |
| −0.608 | −0.972 | 0.333 |
| −0.283 | −0.169 | 0.333 |
| −0.422 | −0.528 | 0.333 |
| −0.316 | −0.259 | 0.333 |
| −0.252 | −0.078 | 0.333 |
| −0.270 | −0.667 | 0.333 |
| −0.175 | −0.097 | 0.333 |

-continued

| X | Y | Z' |
|---|---|---|
| −2.670 | −4.420 | 0.444 |
| −1.479 | −4.750 | 0.444 |
| −2.555 | −4.584 | 0.444 |
| −2.131 | −4.853 | 0.444 |
| −1.410 | −4.676 | 0.444 |
| −2.222 | −4.811 | 0.444 |
| −2.685 | −4.028 | 0.444 |
| −1.348 | −4.597 | 0.444 |
| −1.292 | −4.513 | 0.444 |
| −1.557 | −4.814 | 0.444 |
| −2.279 | −3.590 | 0.444 |
| −1.241 | −4.426 | 0.444 |
| −1.193 | −4.338 | 0.444 |
| −1.643 | −4.866 | 0.444 |
| −2.620 | −4.507 | 0.444 |
| −2.036 | −4.887 | 0.444 |
| −2.582 | −3.856 | 0.444 |
| −2.478 | −4.650 | 0.444 |
| −2.395 | −4.707 | 0.444 |
| −2.356 | −3.655 | 0.444 |
| −1.149 | −4.247 | 0.444 |
| −2.641 | −3.938 | 0.444 |
| −1.069 | −4.062 | 0.444 |
| −2.433 | −3.720 | 0.444 |
| −2.711 | −4.125 | 0.444 |
| −1.033 | −3.968 | 0.444 |
| −1.938 | −4.909 | 0.444 |
| −1.837 | −4.915 | 0.444 |
| −2.510 | −3.785 | 0.444 |
| −2.310 | −4.761 | 0.444 |
| −1.108 | −4.155 | 0.444 |
| −2.718 | −4.226 | 0.444 |
| −2.704 | −4.325 | 0.444 |
| −1.738 | −4.900 | 0.444 |
| −0.770 | −3.100 | 0.444 |
| −3.934 | −3.682 | 0.444 |
| −1.542 | −2.767 | 0.444 |
| −0.904 | −3.586 | 0.444 |
| −0.723 | −2.904 | 0.444 |
| −1.433 | −2.597 | 0.444 |
| −0.847 | −3.392 | 0.444 |
| −1.658 | −2.932 | 0.444 |
| −1.719 | −3.012 | 0.444 |
| −1.782 | −3.091 | 0.444 |
| −0.795 | −3.197 | 0.444 |
| −1.914 | −3.243 | 0.444 |
| −1.983 | −3.316 | 0.444 |
| −0.998 | −3.873 | 0.444 |
| −2.055 | −3.387 | 0.444 |
| −2.128 | −3.457 | 0.444 |
| −2.203 | −3.524 | 0.444 |
| −0.875 | −3.489 | 0.444 |
| −1.847 | −3.168 | 0.444 |
| −1.599 | −2.850 | 0.444 |
| −0.746 | −3.002 | 0.444 |
| −0.821 | −3.295 | 0.444 |
| −1.487 | −2.682 | 0.444 |
| −0.965 | −3.778 | 0.444 |
| −0.700 | −2.805 | 0.444 |
| −0.933 | −1.608 | 0.444 |
| −1.099 | −1.975 | 0.444 |
| −0.616 | −2.411 | 0.444 |
| −0.540 | −2.015 | 0.444 |
| −0.437 | −1.419 | 0.444 |
| −0.597 | −2.312 | 0.444 |
| −0.854 | −1.423 | 0.444 |
| −1.014 | −1.793 | 0.444 |
| −1.144 | −2.066 | 0.444 |
| −0.522 | −1.916 | 0.444 |
| −0.487 | −1.717 | 0.444 |
| −0.470 | −1.618 | 0.444 |
| −0.504 | −1.817 | 0.444 |
| −0.778 | −1.236 | 0.444 |
| −1.235 | −2.246 | 0.444 |
| −0.657 | −2.608 | 0.444 |
| −0.577 | −2.213 | 0.444 |
| −0.679 | −2.707 | 0.444 |

-continued

| X | Y | Z' |
|---|---|---|
| −1.189 | −2.156 | 0.444 |
| −1.382 | −2.510 | 0.444 |
| −1.282 | −2.335 | 0.444 |
| −0.453 | −1.518 | 0.444 |
| −1.331 | −2.423 | 0.444 |
| −0.973 | −1.701 | 0.444 |
| −0.636 | −2.510 | 0.444 |
| −0.558 | −2.114 | 0.444 |
| −1.056 | −1.884 | 0.444 |
| −0.893 | −1.516 | 0.444 |
| −0.816 | −1.329 | 0.444 |
| −0.314 | −0.622 | 0.444 |
| −0.218 | 0.077 | 0.444 |
| −0.494 | −0.481 | 0.444 |
| −0.269 | 0.188 | 0.444 |
| −0.421 | −1.319 | 0.444 |
| −0.405 | −1.220 | 0.444 |
| −0.389 | −1.120 | 0.444 |
| −0.741 | −1.142 | 0.444 |
| −0.360 | −0.101 | 0.444 |
| −0.258 | −0.222 | 0.444 |
| −0.563 | −0.671 | 0.444 |
| −0.393 | −0.196 | 0.444 |
| −0.528 | −0.576 | 0.444 |
| −0.245 | −0.123 | 0.444 |
| −0.300 | −0.522 | 0.444 |
| −0.232 | −0.023 | 0.444 |
| −0.205 | 0.177 | 0.444 |
| −0.329 | −0.722 | 0.444 |
| −0.298 | 0.091 | 0.444 |
| −0.669 | −0.954 | 0.444 |
| −0.344 | −0.821 | 0.444 |
| −0.705 | −1.048 | 0.444 |
| −0.598 | −0.765 | 0.444 |
| −0.633 | −0.860 | 0.444 |
| −0.359 | −0.921 | 0.444 |
| −0.272 | −0.322 | 0.444 |
| −0.426 | −0.291 | 0.444 |
| −0.460 | −0.386 | 0.444 |
| −0.329 | −0.005 | 0.444 |
| −0.374 | −1.021 | 0.444 |
| −0.286 | −0.422 | 0.444 |
| −0.205 | 0.177 | 0.444 |
| −2.634 | −4.024 | 0.556 |
| −2.682 | −4.117 | 0.556 |
| −1.922 | −5.046 | 0.556 |
| −1.817 | −5.046 | 0.556 |
| −1.715 | −5.025 | 0.556 |
| −1.620 | −4.983 | 0.556 |
| −1.534 | −4.923 | 0.556 |
| −1.457 | −4.852 | 0.556 |
| −1.389 | −4.773 | 0.556 |
| −1.327 | −4.689 | 0.556 |
| −2.711 | −4.217 | 0.556 |
| −2.718 | −4.321 | 0.556 |
| −2.705 | −4.425 | 0.556 |
| −1.271 | −4.601 | 0.556 |
| −1.220 | −4.509 | 0.556 |
| −1.129 | −4.321 | 0.556 |
| −2.671 | −4.523 | 0.556 |
| −2.619 | −4.614 | 0.556 |
| −2.551 | −4.694 | 0.556 |
| −2.473 | −4.763 | 0.556 |
| −2.390 | −4.827 | 0.556 |
| −2.305 | −4.887 | 0.556 |
| −2.216 | −4.942 | 0.556 |
| −2.122 | −4.989 | 0.556 |
| −2.024 | −5.025 | 0.556 |
| −2.569 | −3.942 | 0.556 |
| −1.173 | −4.416 | 0.556 |
| −0.701 | −2.923 | 0.556 |
| −1.671 | −3.073 | 0.556 |
| −1.799 | −3.238 | 0.556 |
| −1.867 | −3.318 | 0.556 |
| −1.937 | −3.395 | 0.556 |
| −2.010 | −3.470 | 0.556 |
| −2.086 | −3.542 | 0.556 |

-continued

| X | Y | Z' |
|---|---|---|
| −2.164 | −3.612 | 0.556 |
| −2.244 | −3.679 | 0.556 |
| −2.326 | −3.744 | 0.556 |
| −1.087 | −4.225 | 0.556 |
| −1.049 | −4.128 | 0.556 |
| −1.012 | −4.030 | 0.556 |
| −0.978 | −3.931 | 0.556 |
| −0.945 | −3.832 | 0.556 |
| −2.409 | −3.808 | 0.556 |
| −2.492 | −3.871 | 0.556 |
| −0.913 | −3.732 | 0.556 |
| −0.883 | −3.632 | 0.556 |
| −1.734 | −3.157 | 0.556 |
| −0.854 | −3.531 | 0.556 |
| −0.826 | −3.431 | 0.556 |
| −1.389 | −2.633 | 0.556 |
| −0.800 | −3.330 | 0.556 |
| −1.442 | −2.723 | 0.556 |
| −0.774 | −3.228 | 0.556 |
| −1.496 | −2.812 | 0.556 |
| −0.749 | −3.127 | 0.556 |
| −0.725 | −3.025 | 0.556 |
| −1.552 | −2.901 | 0.556 |
| −1.611 | −2.987 | 0.556 |
| −0.750 | −1.202 | 0.556 |
| −1.062 | −1.978 | 0.556 |
| −1.105 | −2.073 | 0.556 |
| −0.678 | −2.821 | 0.556 |
| −0.656 | −2.719 | 0.556 |
| −0.614 | −2.514 | 0.556 |
| −0.593 | −2.411 | 0.556 |
| −0.573 | −2.309 | 0.556 |
| −0.939 | −1.689 | 0.556 |
| −1.149 | −2.168 | 0.556 |
| −0.554 | −2.206 | 0.556 |
| −0.635 | −2.616 | 0.556 |
| −0.787 | −1.300 | 0.556 |
| −1.194 | −2.262 | 0.556 |
| −0.535 | −2.103 | 0.556 |
| −0.516 | −2.000 | 0.556 |
| −0.498 | −1.897 | 0.556 |
| −0.480 | −1.794 | 0.556 |
| −0.463 | −1.691 | 0.556 |
| −0.824 | −1.397 | 0.556 |
| −1.241 | −2.356 | 0.556 |
| −0.446 | −1.588 | 0.556 |
| −0.429 | −1.484 | 0.556 |
| −0.862 | −1.495 | 0.556 |
| −0.412 | −1.381 | 0.556 |
| −1.289 | −2.449 | 0.556 |
| −1.020 | −1.882 | 0.556 |
| −1.338 | −2.541 | 0.556 |
| −0.900 | −1.592 | 0.556 |
| −0.979 | −1.786 | 0.556 |
| −0.194 | 0.172 | 0.556 |
| −0.181 | 0.276 | 0.556 |
| −0.439 | −0.313 | 0.556 |
| −0.276 | 0.183 | 0.556 |
| −0.609 | −0.808 | 0.556 |
| −0.396 | −1.278 | 0.556 |
| −0.473 | −0.412 | 0.556 |
| −0.181 | 0.276 | 0.556 |
| −0.380 | −1.174 | 0.556 |
| −0.245 | 0.283 | 0.556 |
| −0.307 | 0.084 | 0.556 |
| −0.339 | −0.016 | 0.556 |
| −0.372 | −0.115 | 0.556 |
| −0.405 | −0.214 | 0.556 |
| −0.365 | −1.071 | 0.556 |
| −0.507 | −0.511 | 0.556 |
| −0.541 | −0.610 | 0.556 |
| −0.644 | −0.906 | 0.556 |
| −0.349 | −0.968 | 0.556 |
| −0.220 | −0.035 | 0.556 |
| −0.679 | −1.005 | 0.556 |
| −0.714 | −1.103 | 0.556 |
| −0.334 | −0.864 | 0.556 |

-continued

| X | Y | Z' |
|---|---|---|
| −0.319 | −0.761 | 0.556 |
| −0.304 | −0.657 | 0.556 |
| −0.290 | −0.553 | 0.556 |
| −0.276 | −0.450 | 0.556 |
| −0.575 | −0.709 | 0.556 |
| −0.207 | 0.069 | 0.556 |
| −0.261 | −0.346 | 0.556 |
| −0.248 | −0.242 | 0.556 |
| −0.234 | −0.139 | 0.556 |
| −2.707 | −4.531 | 0.667 |
| −2.481 | −4.884 | 0.667 |
| −2.400 | 4.954 | 0.667 |
| −1.621 | −5.111 | 0.667 |
| −2.315 | −5.018 | 0.667 |
| −2.476 | −3.973 | 0.667 |
| −1.456 | −4.975 | 0.667 |
| −2.558 | −4.042 | 0.667 |
| −2.626 | −4.124 | 0.667 |
| −2.678 | −4.217 | 0.667 |
| −2.226 | −5.077 | 0.667 |
| −2.131 | −5.127 | 0.667 |
| −1.387 | −4.894 | 0.667 |
| −1.324 | −4.808 | 0.667 |
| −2.709 | −4.319 | 0.667 |
| −1.266 | −4.718 | 0.667 |
| −1.213 | −4.626 | 0.667 |
| −2.031 | −5.164 | 0.667 |
| −2.558 | −4.810 | 0.667 |
| −2.719 | −4.425 | 0.667 |
| −1.927 | −5.184 | 0.667 |
| −2.675 | −4.632 | 0.667 |
| −1.820 | −5.182 | 0.667 |
| −1.717 | −5.157 | 0.667 |
| −1.164 | −4.531 | 0.667 |
| −1.118 | −4.434 | 0.667 |
| −1.076 | −4.337 | 0.667 |
| −2.624 | −4.726 | 0.667 |
| −1.534 | −5.049 | 0.667 |
| −0.926 | −3.937 | 0.667 |
| −1.885 | −3.519 | 0.667 |
| −1.402 | −2.818 | 0.667 |
| −0.893 | −3.835 | 0.667 |
| −1.961 | −3.594 | 0.667 |
| −2.041 | −3.665 | 0.667 |
| −2.124 | −3.732 | 0.667 |
| −2.211 | −3.794 | 0.667 |
| −2.299 | −3.854 | 0.667 |
| −1.507 | −3.004 | 0.667 |
| −2.388 | −3.914 | 0.667 |
| −0.862 | −3.733 | 0.667 |
| −0.831 | −3.631 | 0.667 |
| −1.453 | −2.911 | 0.667 |
| −0.802 | −3.528 | 0.667 |
| −0.747 | −3.321 | 0.667 |
| −0.721 | −3.218 | 0.667 |
| −0.696 | −3.114 | 0.667 |
| −0.672 | −3.010 | 0.667 |
| −1.304 | −2.628 | 0.667 |
| −1.681 | −3.272 | 0.667 |
| −0.648 | −2.906 | 0.667 |
| −0.774 | −3.425 | 0.667 |
| −1.745 | −3.358 | 0.667 |
| −1.813 | −3.440 | 0.667 |
| −1.352 | −2.723 | 0.667 |
| −1.035 | −4.238 | 0.667 |
| −0.997 | −4.138 | 0.667 |
| −1.562 | −3.095 | 0.667 |
| −1.620 | −3.185 | 0.667 |
| −0.961 | −4.038 | 0.667 |
| −1.167 | −2.339 | 0.667 |
| −0.499 | −2.174 | 0.667 |
| −0.479 | −2.069 | 0.667 |
| −0.460 | −1.964 | 0.667 |
| −0.442 | −1.859 | 0.667 |
| −0.424 | −1.753 | 0.667 |
| −0.762 | −1.351 | 0.667 |
| −0.518 | −2.279 | 0.667 |

-continued

| X | Y | Z' |
|---|---|---|
| −1.211 | −2.436 | 0.667 |
| −0.406 | −1.648 | 0.667 |
| −0.724 | −1.251 | 0.667 |
| −0.388 | −1.543 | 0.667 |
| −0.800 | −1.450 | 0.667 |
| −0.838 | −1.550 | 0.667 |
| −0.877 | −1.650 | 0.667 |
| −0.371 | −1.437 | 0.667 |
| −0.354 | −1.332 | 0.667 |
| −1.257 | −2.532 | 0.667 |
| −0.956 | −1.848 | 0.667 |
| −0.625 | −2.802 | 0.667 |
| −1.038 | −2.045 | 0.667 |
| −0.997 | −1.947 | 0.667 |
| −0.602 | −2.697 | 0.667 |
| −1.080 | −2.143 | 0.667 |
| −0.917 | −1.749 | 0.667 |
| −0.581 | −2.593 | 0.667 |
| −0.559 | −2.488 | 0.667 |
| −1.123 | −2.241 | 0.667 |
| −0.539 | −2.384 | 0.667 |
| −0.577 | −0.850 | 0.667 |
| −0.127 | 0.253 | 0.667 |
| −0.228 | −0.487 | 0.667 |
| −0.213 | −0.381 | 0.667 |
| −0.155 | 0.042 | 0.667 |
| −0.614 | −0.950 | 0.667 |
| −0.224 | 0.158 | 0.667 |
| −0.198 | −0.276 | 0.667 |
| −0.192 | 0.260 | 0.667 |
| −0.169 | −0.064 | 0.667 |
| −0.687 | −1.151 | 0.667 |
| −0.257 | 0.056 | 0.667 |
| −0.141 | 0.148 | 0.667 |
| −0.127 | 0.253 | 0.667 |
| −0.650 | −1.050 | 0.667 |
| −0.291 | −0.045 | 0.667 |
| −0.338 | −1.226 | 0.667 |
| −0.321 | −1.121 | 0.667 |
| −0.362 | −0.247 | 0.667 |
| −0.305 | −1.015 | 0.667 |
| −0.326 | −0.146 | 0.667 |
| −0.397 | −0.347 | 0.667 |
| −0.433 | −0.448 | 0.667 |
| −0.469 | −0.548 | 0.667 |
| −0.289 | −0.910 | 0.667 |
| −0.505 | −0.649 | 0.667 |
| −0.274 | −0.804 | 0.667 |
| −0.184 | −0.170 | 0.667 |
| −0.258 | −0.698 | 0.667 |
| −0.541 | −0.749 | 0.667 |
| −0.243 | −0.593 | 0.667 |
| −1.629 | −5.246 | 0.778 |
| −1.542 | −5.181 | 0.778 |
| −1.464 | −5.106 | 0.778 |
| −1.393 | −5.024 | 0.778 |
| −1.271 | −4.845 | 0.778 |
| −1.329 | −4.937 | 0.778 |
| −1.036 | −4.358 | 0.778 |
| −1.217 | −4.751 | 0.778 |
| −1.167 | −4.655 | 0.778 |
| −1.121 | −4.557 | 0.778 |
| −1.077 | −4.458 | 0.778 |
| −0.924 | −4.052 | 0.778 |
| −0.890 | −3.950 | 0.778 |
| −0.857 | −3.846 | 0.778 |
| −0.826 | −3.743 | 0.778 |
| −0.793 | −3.639 | 0.778 |
| −0.766 | −3.534 | 0.778 |
| −0.737 | −3.430 | 0.778 |
| −0.709 | −3.325 | 0.778 |
| −0.682 | −3.220 | 0.778 |
| −0.656 | −3.115 | 0.778 |
| −0.631 | −3.010 | 0.778 |
| −0.606 | −2.904 | 0.778 |
| −1.283 | −2.726 | 0.778 |
| −1.332 | −2.823 | 0.778 |

-continued

| X | Y | Z' |
|---|---|---|
| −1.382 | −2.919 | 0.778 |
| −1.433 | −3.015 | 0.778 |
| −0.960 | −4.155 | 0.778 |
| −1.487 | −3.109 | 0.778 |
| −0.997 | −4.257 | 0.778 |
| −2.413 | −5.097 | 0.778 |
| −2.330 | −5.167 | 0.778 |
| −2.241 | −5.229 | 0.778 |
| −2.145 | −5.280 | 0.778 |
| −2.043 | −5.316 | 0.778 |
| −1.937 | −5.333 | 0.778 |
| −1.829 | −5.326 | 0.778 |
| −2.565 | −4.943 | 0.778 |
| −2.280 | −3.982 | 0.778 |
| −2.371 | −4.039 | 0.778 |
| −2.464 | −4.096 | 0.778 |
| −2.549 | −4.162 | 0.778 |
| −2.621 | −4.244 | 0.778 |
| −2.491 | −5.022 | 0.778 |
| −2.674 | −4.338 | 0.778 |
| −2.708 | −4.440 | 0.778 |
| −2.720 | −4.548 | 0.778 |
| −2.709 | −4.656 | 0.778 |
| −1.725 | −5.296 | 0.778 |
| −2.678 | −4.759 | 0.778 |
| −2.629 | −4.856 | 0.778 |
| −1.864 | −3.637 | 0.778 |
| −1.600 | −3.293 | 0.778 |
| −2.019 | −3.788 | 0.778 |
| −2.103 | −3.857 | 0.778 |
| −2.190 | −3.921 | 0.778 |
| −1.661 | −3.383 | 0.778 |
| −1.725 | −3.471 | 0.778 |
| −1.792 | −3.555 | 0.778 |
| −1.542 | −3.202 | 0.778 |
| −1.939 | −3.715 | 0.778 |
| −0.513 | −2.481 | 0.778 |
| −0.312 | −1.416 | 0.778 |
| −0.469 | −2.269 | 0.778 |
| −0.448 | −2.162 | 0.778 |
| −0.428 | −2.056 | 0.778 |
| −0.408 | −1.949 | 0.778 |
| −0.491 | −2.375 | 0.778 |
| −0.331 | −1.523 | 0.778 |
| −0.388 | −1.843 | 0.778 |
| −0.368 | −1.736 | 0.778 |
| −0.349 | −1.630 | 0.778 |
| −0.582 | −2.799 | 0.778 |
| −0.558 | −2.693 | 0.778 |
| −0.535 | −2.587 | 0.778 |
| −0.384 | −0.519 | 0.778 |
| −0.276 | −1.202 | 0.778 |
| −0.259 | −1.095 | 0.778 |
| −0.422 | −0.621 | 0.778 |
| −0.241 | −0.988 | 0.778 |
| −0.460 | −0.722 | 0.778 |
| −0.224 | −0.881 | 0.778 |
| −0.208 | −0.774 | 0.778 |
| −0.498 | −0.824 | 0.778 |
| −0.536 | −0.925 | 0.778 |
| −0.191 | −0.667 | 0.778 |
| −0.575 | −1.026 | 0.778 |
| −0.174 | −0.560 | 0.778 |
| −0.158 | −0.453 | 0.778 |
| −0.064 | 0.190 | 0.778 |
| −0.142 | −0.346 | 0.778 |
| −0.129 | 0.195 | 0.778 |
| −0.126 | −0.239 | 0.778 |
| −0.110 | −0.132 | 0.778 |
| −0.163 | 0.092 | 0.778 |
| −0.198 | −0.010 | 0.778 |
| −0.095 | −0.024 | 0.778 |
| −0.079 | 0.083 | 0.778 |
| −0.064 | 0.190 | 0.778 |
| −0.234 | −0.113 | 0.778 |
| −0.308 | −0.316 | 0.778 |
| −0.271 | −0.215 | 0.778 |

-continued

| X | Y | Z' |
|---|---|---|
| −0.346 | −0.418 | 0.778 |
| −0.294 | −1.309 | 0.778 |
| −0.810 | −1.633 | 0.778 |
| −0.973 | −2.034 | 0.778 |
| −1.015 | −2.134 | 0.778 |
| −1.058 | −2.233 | 0.778 |
| −1.101 | −2.333 | 0.778 |
| −1.190 | −2.530 | 0.778 |
| −1.236 | −2.628 | 0.778 |
| −0.691 | −1.330 | 0.778 |
| −0.730 | −1.431 | 0.778 |
| −0.770 | −1.532 | 0.778 |
| −0.652 | −1.229 | 0.778 |
| −0.850 | −1.733 | 0.778 |
| −0.891 | −1.834 | 0.778 |
| −0.932 | −1.934 | 0.778 |
| −1.145 | −2.432 | 0.778 |
| −0.613 | −1.128 | 0.778 |
| −1.115 | −4.835 | 0.889 |
| −2.349 | −5.344 | 0.889 |
| −1.940 | −5.471 | 0.889 |
| −2.684 | −4.924 | 0.889 |
| −1.533 | −5.330 | 0.889 |
| −1.064 | −4.738 | 0.889 |
| −2.640 | −5.024 | 0.889 |
| −2.675 | −4.498 | 0.889 |
| −1.831 | −5.459 | 0.889 |
| −2.712 | −4.819 | 0.889 |
| −2.709 | −4.602 | 0.889 |
| −2.512 | −5.200 | 0.889 |
| −2.255 | −5.399 | 0.889 |
| −2.154 | −5.449 | 0.889 |
| −1.626 | −5.386 | 0.889 |
| −1.230 | −5.020 | 0.889 |
| −2.621 | −4.404 | 0.889 |
| −2.721 | −4.710 | 0.889 |
| −1.368 | −5.189 | 0.889 |
| −0.973 | −4.540 | 0.889 |
| −2.435 | −5.277 | 0.889 |
| −1.170 | −4.929 | 0.889 |
| −2.549 | −4.322 | 0.889 |
| −1.017 | −4.640 | 0.889 |
| −0.933 | −4.439 | 0.889 |
| −2.581 | −5.115 | 0.889 |
| −2.096 | −4.023 | 0.889 |
| −2.182 | −4.089 | 0.889 |
| −2.272 | −4.150 | 0.889 |
| −1.447 | −5.264 | 0.889 |
| −2.367 | −4.204 | 0.889 |
| −1.296 | −5.107 | 0.889 |
| −1.726 | −5.430 | 0.889 |
| −2.463 | −4.256 | 0.889 |
| −2.048 | −5.465 | 0.889 |
| −0.895 | −4.337 | 0.889 |
| −1.432 | −3.166 | 0.889 |
| −0.650 | −3.500 | 0.889 |
| −0.576 | −3.182 | 0.889 |
| −0.859 | −4.234 | 0.889 |
| −0.825 | −4.130 | 0.889 |
| −0.704 | −3.711 | 0.889 |
| −1.486 | −3.261 | 0.889 |
| −0.792 | −4.026 | 0.889 |
| −0.600 | −3.288 | 0.889 |
| −1.541 | −3.354 | 0.889 |
| −1.600 | −3.447 | 0.889 |
| −1.660 | −3.537 | 0.889 |
| −0.732 | −3.817 | 0.889 |
| −1.724 | −3.626 | 0.889 |
| −1.791 | −3.712 | 0.889 |
| −1.861 | −3.795 | 0.889 |
| −1.935 | −3.875 | 0.889 |
| −0.677 | −3.606 | 0.889 |
| −0.625 | −3.394 | 0.889 |
| −2.013 | −3.951 | 0.889 |
| −0.552 | −3.075 | 0.889 |
| −1.186 | −2.680 | 0.889 |
| −1.232 | −2.778 | 0.889 |

-continued

| X | Y | Z' |
|---|---|---|
| −1.280 | −2.876 | 0.889 |
| −1.329 | −2.974 | 0.889 |
| −1.380 | −3.070 | 0.889 |
| −0.762 | −3.922 | 0.889 |
| −0.529 | −2.968 | 0.889 |
| −0.750 | −1.681 | 0.889 |
| −0.321 | −1.898 | 0.889 |
| −0.421 | −2.434 | 0.889 |
| −0.792 | −1.781 | 0.889 |
| −0.463 | −2.648 | 0.889 |
| −0.834 | −1.882 | 0.889 |
| −0.485 | −2.755 | 0.889 |
| −0.877 | −1.982 | 0.889 |
| −0.341 | −2.006 | 0.889 |
| −0.264 | −1.576 | 0.889 |
| −0.360 | −2.113 | 0.889 |
| −0.919 | −2.082 | 0.889 |
| −0.963 | −2.182 | 0.889 |
| −1.006 | −2.282 | 0.889 |
| −0.283 | −1.684 | 0.889 |
| −1.095 | −2.482 | 0.889 |
| −1.050 | −2.382 | 0.889 |
| −0.302 | −1.791 | 0.889 |
| −0.401 | −2.327 | 0.889 |
| −1.140 | −2.581 | 0.889 |
| −0.582 | −1.278 | 0.889 |
| −0.442 | −2.541 | 0.889 |
| −0.380 | −2.220 | 0.889 |
| −0.507 | −2.862 | 0.889 |
| −0.245 | −1.469 | 0.889 |
| −0.227 | −1.361 | 0.889 |
| −0.624 | −1.379 | 0.889 |
| −0.666 | −1.479 | 0.889 |
| −0.708 | −1.580 | 0.889 |
| −0.032 | −0.178 | 0.889 |
| −0.214 | −0.368 | 0.889 |
| −0.254 | −0.470 | 0.889 |
| −0.294 | −0.571 | 0.889 |
| −0.335 | −0.672 | 0.889 |
| −0.458 | −0.975 | 0.889 |
| −0.376 | −0.773 | 0.889 |
| −0.101 | −0.609 | 0.889 |
| −0.119 | −0.716 | 0.889 |
| −0.049 | −0.286 | 0.889 |
| −0.417 | −0.874 | 0.889 |
| −0.172 | −1.039 | 0.889 |
| −0.500 | −1.076 | 0.889 |
| −0.190 | −1.146 | 0.889 |
| −0.015 | −0.070 | 0.889 |
| −0.541 | −1.177 | 0.889 |
| −0.084 | −0.501 | 0.889 |
| 0.002 | 0.037 | 0.889 |
| 0.002 | 0.037 | 0.889 |
| −0.064 | 0.041 | 0.889 |
| −0.067 | −0.393 | 0.889 |
| −0.100 | −0.062 | 0.889 |
| −0.137 | −0.165 | 0.889 |
| −0.154 | −0.931 | 0.889 |
| −0.209 | −1.254 | 0.889 |
| −0.175 | −0.267 | 0.889 |
| −0.137 | −0.824 | 0.889 |
| −2.383 | −5.538 | 1.000 |
| −2.064 | −4.266 | 1.000 |
| −1.208 | −5.241 | 1.000 |
| −1.139 | −5.158 | 1.000 |
| −1.903 | −4.122 | 1.000 |
| −2.339 | −4.433 | 1.000 |
| −2.668 | −5.229 | 1.000 |
| −2.599 | −4.619 | 1.000 |
| −2.554 | −5.410 | 1.000 |
| −1.454 | −5.447 | 1.000 |
| −1.549 | −5.498 | 1.000 |
| −0.834 | −4.591 | 1.000 |
| −2.436 | −4.480 | 1.000 |
| −2.698 | −4.808 | 1.000 |
| −2.619 | −5.324 | 1.000 |
| −1.963 | −5.608 | 1.000 |

-continued

| X | Y | Z' |
|---|---|---|
| −2.721 | −5.021 | 1.000 |
| −2.283 | −5.578 | 1.000 |
| −2.657 | −4.709 | 1.000 |
| −1.019 | −4.979 | 1.000 |
| −2.178 | −5.602 | 1.000 |
| −2.071 | −5.612 | 1.000 |
| −1.283 | −5.317 | 1.000 |
| −1.981 | −4.197 | 1.000 |
| −2.243 | −4.384 | 1.000 |
| −2.703 | −5.127 | 1.000 |
| −1.649 | −5.538 | 1.000 |
| −2.151 | −4.328 | 1.000 |
| −0.967 | −4.885 | 1.000 |
| −0.875 | −4.690 | 1.000 |
| −1.365 | −5.387 | 1.000 |
| −1.752 | −5.570 | 1.000 |
| −2.719 | −4.914 | 1.000 |
| −2.474 | −5.482 | 1.000 |
| −2.524 | −4.541 | 1.000 |
| −0.797 | −4.490 | 1.000 |
| −1.857 | −5.593 | 1.000 |
| −0.919 | −4.788 | 1.000 |
| −1.077 | −5.070 | 1.000 |
| −0.610 | −3.872 | 1.000 |
| −1.698 | −3.874 | 1.000 |
| −1.110 | −2.726 | 1.000 |
| −1.426 | −3.410 | 1.000 |
| −0.444 | −3.137 | 1.000 |
| −1.197 | −2.923 | 1.000 |
| −1.332 | −3.216 | 1.000 |
| −1.830 | −4.043 | 1.000 |
| −0.402 | −2.926 | 1.000 |
| −1.581 | −3.693 | 1.000 |
| −1.286 | −3.119 | 1.000 |
| −0.466 | −3.242 | 1.000 |
| −1.154 | −2.824 | 1.000 |
| −0.488 | −3.348 | 1.000 |
| −0.511 | −3.453 | 1.000 |
| −0.559 | −3.663 | 1.000 |
| −1.241 | −3.021 | 1.000 |
| −1.527 | −3.600 | 1.000 |
| −1.638 | −3.784 | 1.000 |
| −0.728 | −4.286 | 1.000 |
| −0.666 | −4.080 | 1.000 |
| −0.423 | −3.031 | 1.000 |
| −3.584 | −3.767 | 1.000 |
| −0.696 | −4.183 | 1.000 |
| −1.476 | −3.505 | 1.000 |
| −0.638 | −3.976 | 1.000 |
| −0.535 | −3.558 | 1.000 |
| −0.761 | −4.388 | 1.000 |
| −1.762 | −3.960 | 1.000 |
| −1.378 | −3.313 | 1.000 |
| −0.283 | −2.291 | 1.000 |
| −1.067 | −2.627 | 1.000 |
| −0.226 | −1.973 | 1.000 |
| −0.709 | −1.844 | 1.000 |
| −0.134 | −1.443 | 1.000 |
| −0.382 | −2.820 | 1.000 |
| −0.302 | −2.397 | 1.000 |
| −0.935 | −2.333 | 1.000 |
| −0.152 | −1.549 | 1.000 |
| −0.890 | −2.235 | 1.000 |
| −0.170 | −1.655 | 1.000 |
| −0.361 | −2.714 | 1.000 |
| −0.189 | −1.761 | 1.000 |
| −0.207 | −1.867 | 1.000 |
| −0.617 | −1.650 | 1.000 |
| −0.245 | −2.079 | 1.000 |
| −0.477 | −1.358 | 1.000 |
| −0.570 | −1.553 | 1.000 |
| −1.023 | −2.529 | 1.000 |
| −0.341 | −2.609 | 1.000 |
| −0.845 | −2.137 | 1.000 |
| −0.663 | −1.747 | 1.000 |
| −0.755 | −1.941 | 1.000 |
| −0.979 | −2.431 | 1.000 |

-continued

| X | Y | Z' |
|---|---|---|
| −0.800 | −2.039 | 1.000 |
| −0.264 | −2.185 | 1.000 |
| −0.322 | −2.503 | 1.000 |
| −0.524 | −1.456 | 1.000 |
| −0.202 | −0.774 | 1.000 |
| −0.076 | −0.477 | 1.000 |
| −0.097 | −1.231 | 1.000 |
| −0.115 | −1.337 | 1.000 |
| −0.061 | −1.019 | 1.000 |
| −0.025 | −0.807 | 1.000 |
| −0.431 | −1.261 | 1.000 |
| −0.385 | −1.164 | 1.000 |
| 0.065 | −0.276 | 1.000 |
| −0.158 | −0.676 | 1.000 |
| −0.116 | −0.577 | 1.000 |
| 0.047 | −0.382 | 1.000 |
| 0.065 | −0.276 | 1.000 |
| 0.029 | −0.488 | 1.000 |
| −0.079 | −1.125 | 1.000 |
| −0.001 | −0.275 | 1.000 |
| −0.037 | −0.377 | 1.000 |
| −0.338 | −1.067 | 1.000 |
| 0.011 | −0.594 | 1.000 |
| −0.143 | −0.913 | 1.000 |
| −0.007 | −0.700 | 1.000 |
| −0.247 | −0.872 | 1.000 |
| −0.292 | −0.970 | 1.000 |

It also will be appreciated that the airfoil disclosed in Table 1 may be scaled up or down geometrically for use in similar turbine designs. Consequently, the coordinate values set forth in Table 1 may be scaled upwardly or downwardly such that the airfoil section shape remains unchanged. A scaled version of the coordinates in Table 1 would be represented by X, Y and, optionally, Z coordinate values (after the Z values have been converted to inches) multiplied or divided by the same constant or number.

It should be apparent that the foregoing relates only to the preferred embodiments of the present invention and that numerous changes and modifications may be made herein without departing from the spirit and scope of the invention as defined by the following claims and equivalents thereof.

What is claimed is:

1. A turbine nozzle comprising an airfoil shape in an envelope within ±0.160 inches in a direction normal to any airfoil surface location wherein the airfoil comprises a nominal profile substantially in accordance with Cartesian coordinate values of X, Y and Z set forth in Table 1, wherein the Z coordinate comprises a nondimensional value along a nozzle stacking line coincident with a radius from a turbine axis of rotation and convertible to a Z distance in inches by multiplying the Z value by a height of the airfoil and adding that product to a root radius of the nozzle, and wherein X and Y comprise distances in inches defining the airfoil profile at each distance Z, the profiles at the Z distances being joined smoothly with one another to form a complete airfoil shape.

2. The turbine nozzle according to claim 1, wherein X and Y comprise distances being scalable as a function of the same constant or number to provide a scaled up or scaled down nozzle airfoil.

3. A turbine nozzle according to claim 1 forming part of a first stage of a turbine.

4. A turbine nozzle according to claim 1, wherein the Z value is measured from an intersection of a nozzle centerline along the radius from the turbine axis and the root radius of a flowpath through the turbine.

5. A turbine nozzle according to claim 1, wherein the root radius of the nozzle airfoil comprises approximately 21.25 inches and the airfoil comprises a height from the root radius of approximately 4.275 inches.

6. A turbine nozzle comprising an airfoil shape with an uncoated nominal profile substantially in accordance with Cartesian coordinate values of X, Y and Z set forth in Table 1, wherein Z comprises a nondimensional value along a nozzle stacking axis coincident with a radius from a turbine axis of rotation and convertible to a Z distance in inches from said turbine axis by multiplying the Z value by a height of the airfoil and adding that product to a root radius of the nozzle, wherein X and Y comprise distances in inches defining the airfoil profile at each distance Z, the profiles at the Z distances being joined smoothly with one another to form a complete airfoil shape.

7. The turbine nozzle according to claim 6, wherein X and Y comprise distances being scalable as a function of the same constant or number to provide a scaled up or scaled down nozzle airfoil.

8. A turbine nozzle according to claim 6 forming part of a first stage of a turbine.

9. A turbine nozzle according to claim 6, wherein the root radius of the nozzle airfoil comprises approximately 21.25 inches and the airfoil comprises a height from the root radius of approximately 4.275 inches.

10. A turbine comprising a nozzle arrangement comprising a plurality of nozzles, with each nozzle comprising an airfoil shape in an envelope within ±0.160 inches in a direction normal to any airfoil surface location wherein the airfoil comprises a nominal profile substantially in accordance with Cartesian coordinate values of X, Y and Z set forth in Table 1, wherein the Z coordinate comprises a nondimensional value along a nozzle stacking axis coincident with a radius from a turbine axis of rotation convertible to a Z distance in inches from said turbine axis by multiplying the Z value by a height of the airfoil and adding that product to a root radius of the nozzle, and wherein the X and Y values comprise distances in inches defining the airfoil profile at each distance Z, the profiles at the Z distances being joined smoothly with one another to form a complete airfoil shape.

11. The turbine according to claim 10, wherein X and Y comprise distances being scalable as a function of the same constant or number to provide a scaled up or scaled down nozzle airfoil.

12. A turbine according to claim 10 wherein the turbine comprises a first stage of a turbine.

13. A turbine according to claim 10, wherein the turbine comprises approximately 32 nozzles and Y represents a distance parallel to the turbine axis of rotation.

14. A turbine according to claim 10, wherein the root radius of the nozzle airfoil comprises approximately 21.25 inches and the airfoil comprises a height from the root radius of approximately 4.275 inches.

15. A turbine comprising a nozzle arrangement comprising a plurality of nozzles, each of said nozzles comprising an uncoated nominal airfoil profile substantially in accordance with Cartesian coordinate values of X, Y and Z set forth in Table 1, wherein the Z coordinate comprises a nondimensional value along a nozzle stacking axis coincident with a radius from a turbine axis of rotation convertible to a Z distance in inches from said turbine axis of rotation by multiplying the Z value by a height of the airfoil and adding that product to a root radius of the nozzle, wherein X and Y comprises distances in inches defining the airfoil profile at each distance Z, and the profiles at the Z distances being joined smoothly with one another to form a complete airfoil shape.

16. The turbine according to claim 15, wherein X and Y comprise distances being scalable as a function of the same constant or number to provide a scaled up or scaled down nozzle airfoil.

17. A turbine according to claim 15, wherein the nozzle arrangement comprises a first stage of a turbine.

18. A turbine according to claim 15, wherein the nozzle arrangement comprises approximately thirty two (32) nozzles and Y comprises a distance parallel to the turbine axis of rotation.

19. A turbine according to claim 15, wherein the root radius of the nozzle airfoil comprises approximately 21.25 inches and the airfoil comprises a height from the root radius of approximately 4.275 inches.

* * * * *